US011454080B1

(12) United States Patent
Alharbi

(10) Patent No.: US 11,454,080 B1
(45) Date of Patent: Sep. 27, 2022

(54) DIVERTER SYSTEM FOR WELL CONTROL

(71) Applicant: Saudi Arabian Oil Company, Dhahran (SA)

(72) Inventor: Naif Mohsen Mosleh Alharbi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/531,227

(22) Filed: Nov. 19, 2021

(51) Int. Cl.
*E21B 33/068* (2006.01)
*E21B 33/06* (2006.01)

(52) U.S. Cl.
CPC ..... *E21B 33/068* (2013.01); *E21B 33/06* (2013.01)

(58) Field of Classification Search
CPC ..... E21B 33/068; E21B 33/06
See application file for complete search history.

(56) References Cited

U.S. PATENT DOCUMENTS 491,029 A * 1/1893 Toucey ..... E21B 33/08 277/513
1,639,852 A * 8/1927 King ..... E21B 49/005 175/218
4,524,832 A 6/1985 Roche et al.
5,454,430 A 10/1995 Kennedy et al.
7,997,345 B2 8/2011 Hannegan
9,291,011 B2 * 3/2016 DeBerry ..... E21B 33/03
10,526,868 B2 1/2020 Walton et al.
10,557,324 B2 * 2/2020 Webb ..... E21B 33/03
2008/0210471 A1 * 9/2008 Bailey ..... E21B 34/16 175/48

OTHER PUBLICATIONS

Dril-Quip [Brochure], "ADS Diverter System," 2014, 8 pages.
Wikipedia.com [online], "Elasticity," created on Jul. 16, 2003, [retrieved on May 7, 2021], retrieved from : URL<https://en.wikipedia.org/wiki/Elasticity_(physics)>, 6 pages.

* cited by examiner

*Primary Examiner* — Aaron L Lembo
(74) *Attorney, Agent, or Firm* — Fish & Richardson P.C.

(57) ABSTRACT

A diverter system is configured to control a direction of drilling fluid or gas from a well bore to a surface platform. The diverter system includes a housing configured to receive a casing from a well bore, at least one outlet configured to direct flow of a drilling fluid or gas out of the housing, and a packing element assembly within the housing and coupled to the housing. The packing element assembly includes a first packing element affixed to the housing, the first packing element including at least one balloon configured to expand in response to an actuation input, and a second packing element concentrically within the first packing element, the second packing element including a first half and a second half, the first half coupled to the second half by a plurality of elastic elements.

18 Claims, 7 Drawing Sheets

DIVERTER SYSTEM FOR WELL CONTROL

TECHNICAL FIELD

The present specification generally relates to configurations for well heads for hydrocarbon exploration.

BACKGROUND

For hydrocarbon exploration and extraction, a hydrocarbon well includes one or more safety mechanisms to prevent issues such as leaks or well blowouts. A diverter can be used in an offshore oilfield on platforms and jackup rigs to protect against shallow gas kicks during drilling operations. A diverter system is mostly to control the direction of drilling fluid from a well bore to a surface platform and control the well kick and shallow gas kick.

In the event of a shallow gas kick, the diverter is energized to seal around the drill pipe and divert the gas safely overboard. A diverter system is generally equipped with hydraulic control system during operation and is configured to seal different sizes of drill pipe.

SUMMARY

The present specification describes a diverter system for a well for hydrocarbon exploration, such as during drilling of a well bore. The diverter is secured a casing to form a gas-tight seal is formed. Gas from the well bore is diverted to one or more outlet ports of the diverter system for collection.

The diverter system includes one or more elastic packers (also called packing elements) that enable the diverter system to form a tight seal with casings having a range of diameters. The packing elements are configured to be placed within a housing of the diverter and enable the diverter to accommodate different conductor (also called pipe or casing) diameters. The packing elements can be actuated to adjust their respective diameters by applying a pressure through an external port. Further, the packing elements can be compressed against the casing (for example, using pressurized gas) to form the seal. A degree of deformation of the packing elements can be increased in several ways. First, the degree of deformation of the packing elements can be increased by increasing a pressure of a gas used to compress the packing elements. For example, the gas pressure can be increased from about 750 pounds-per-square-inch (PSI) to about 1000 PSI. In another example, the elasticity of the packing elements can be increased (e.g., by material design or other process) to enable additional deformation of the packing elements. The increased elasticity can enable the packing elements to form a tight seal (for example, relatively tighter than for inelastic packing elements) around a casings having varying diameters. For example, a diverter system is configured to handle a smaller diameter (such as 24 inches). In another example, the diverter system is configured to handle a pipe with a relatively larger diameter (such as 36 inches). For example, a 36-inch diverter system utilizes different sizes of spilt insert packing elements when running different sizes of casing. A range of pipe diameters that can be handled by the diverter system is increased to include pipes of diameters between at least 36 inches to 13⅜ inches.

In some implementations, there is a 27.5-inch spilt insert packing element that inserted into a main body of the diverter. The split packing element is operated using 750 PSI and has a minimum closing diameter of 26 inches. In a conventional assembly, there can be an inability to utilize such a diverter when running a 24-inch casing through a 27.5-inch packing element. This can result in wasted time and repetitive failure. Increasing the elasticity of the packing element by increasing an energizing pressure from 750 PSI up to 1000 PSI results in sealing the 24-inch pipe.

The subject matter described in this specification can be implemented in particular implementations, so as to realize one or more of the following advantages. Generally, at shallow gas wells, a drilling team faces operational challenges in operations processes including installing a 36-inch diverter on 36-inch conductor, running 30-inch casing, and finally running 26-inch casing. After this process occurs, the drilling team nipple down the 36-inch diverter system and nipple up a 30-inch diverter system to complete the job of running the 24-inch intermediate casing.

Generally, there is an inability of the 27.5-inch packing element, of the 36-inch diverter system, to seal the pipe. This is because the diverter has a minimum closing diameter of 26 inches. This lack of sealing results in a direct impact on the drilling process. By increasing the range of 27.5-inch spilt insert packing element to have minimum closing diameter 24 inches, the above issues can be resolved and one or more of the following advantages can be realized. The cost of modifying a drilling packing element is reduced and the extra time needed for modifying the packing element is reduced. For example, the diverter system described in this specification can be used to complete the drilling process in only two days, while modified packing elements can require more than 2-3 extra days for completing the drilling process. These 2-3 days can be saved from the drilling process and signification cost, such as about a hundred thousand dollars in cost savings. The risk level of the drilling process is reduced and the safety of the diverter system is improved because the likelihood of packer failure is reduced compared to conventional diverter systems.

One or more of these advantages are enabled by one or more of the following embodiments.

In as general aspect, a diverter system configured to control a direction of drilling fluid or gas from a well bore to a surface platform. The diverter system includes a housing configured to receive a casing from a well bore; at least one outlet configured to direct flow of a drilling fluid or gas out of the housing; and a packing element assembly within the housing and coupled to the housing. The packing element assembly includes a first packing element affixed to the housing, the first packing element comprising at least one balloon configured to expand in response to an actuation input; and a second packing element concentrically within the first packing element, the second packing element comprising a first half and a second half, the first half coupled to the second half by a plurality of elastic elements; wherein the second packing element is configured to receive the casing from the well bore; and wherein the at least one balloon of the first packing element is configured to compress the second packing element around the casing to seal the second packing element against the casing, preventing flow of the drilling fluid or gas past the packing element assembly and directing the flow the drilling fluid or gas to the at least one outlet.

In some implementations, at least one of the plurality of elastic elements comprises a helical spring.

In some implementations, the at least one of the plurality of elastic elements comprises a stretchable material.

In some implementations, at least one of the plurality of elastic elements is configured for over 50% elasticity.

In some implementations, the second packing element comprises a least one secondary balloon configured to inflate in response to actuation from an external port, wherein actuation of the secondary balloon seals the second packing element to the casing.

In some implementations, the casing is approximately 24 inches, and wherein the second packing element is configured to contract from about 27.5 inches to 24 inches.

In some implementations, the at least one balloon comprises a polymer material that comprises fluorocarbon.

In some implementations, the first packing element is a solid packing element, and wherein the second packing element is a split packing element.

In some implementations, the at least one balloon is actuated by an actuation signal of 1000 to 1300 pounds per square inch (PSI).

In a general aspect, a packing element assembly for a diverter system that is configured to control a direction of drilling fluid or gas from a well bore to a surface platform includes a first packing element affixed to the housing, the first packing element comprising at least one balloon configured to expand in response to an actuation input; and a second packing element concentrically within the first packing element, the second packing element comprising a first half and a second half, the first half coupled to the second half by a plurality of elastic elements; wherein the second packing element is configured to receive the casing from the well bore; and wherein the at least one balloon of the first packing element is configured to compress the second packing element around the casing to seal the second packing element against the casing, preventing flow of the drilling fluid or gas past the packing element assembly and directing the flow the drilling fluid or gas to the at least one outlet.

In some implementations, at least one of the plurality of elastic elements comprises a helical spring.

In some implementations, at least one of the plurality of elastic elements comprises a stretchable material.

In some implementations, the at least one of the plurality of elastic elements is configured for over 50% elasticity.

In some implementations, the second packing element comprises a least one secondary balloon configured to inflate in response to actuation from an external port, wherein actuation of the secondary balloon seals the second packing element to the casing.

In some implementations, the casing is approximately 24 inches, and wherein the second packing element is configured to contract from about 27.5 inches to 24 inches.

In some implementations, the at least one balloon comprises a polymer material that comprises fluorocarbon.

In some implementations, the first packing element is a solid packing element, and wherein the second packing element is a split packing element.

In some implementations, the at least one balloon is actuated by an actuation signal of 1000 to 1300 pounds per square inch (PSI).

The details of one or more embodiments are set forth in the accompanying drawings and the description below. Other features and advantages will be apparent from the description and drawings, and from the claims.

BRIEF DESCRIPTION OF THE DRAWINGS

Like reference numbers and designations in the various drawings indicate like elements.

DETAILED DESCRIPTION

The following specification describes systems and processes for determining hydrocarbon phase behavior for hydrocarbons for compositional reservoir simulation. Various modifications, alterations, and permutations of the disclosed implementations can be made and will be readily apparent to those of ordinary skill in the art, and the general principles defined may be applied to other implementations and applications, without departing from scope of the specification. In some instances, details unnecessary to obtain an understanding of the described subject matter may be omitted so as to not obscure one or more described implementations with unnecessary detail and inasmuch as such details are within the skill of one of ordinary skill in the art. The present specification is not intended to be limited to the described or illustrated implementations, but to be accorded the widest scope consistent with the described principles and features.

Figure 1:
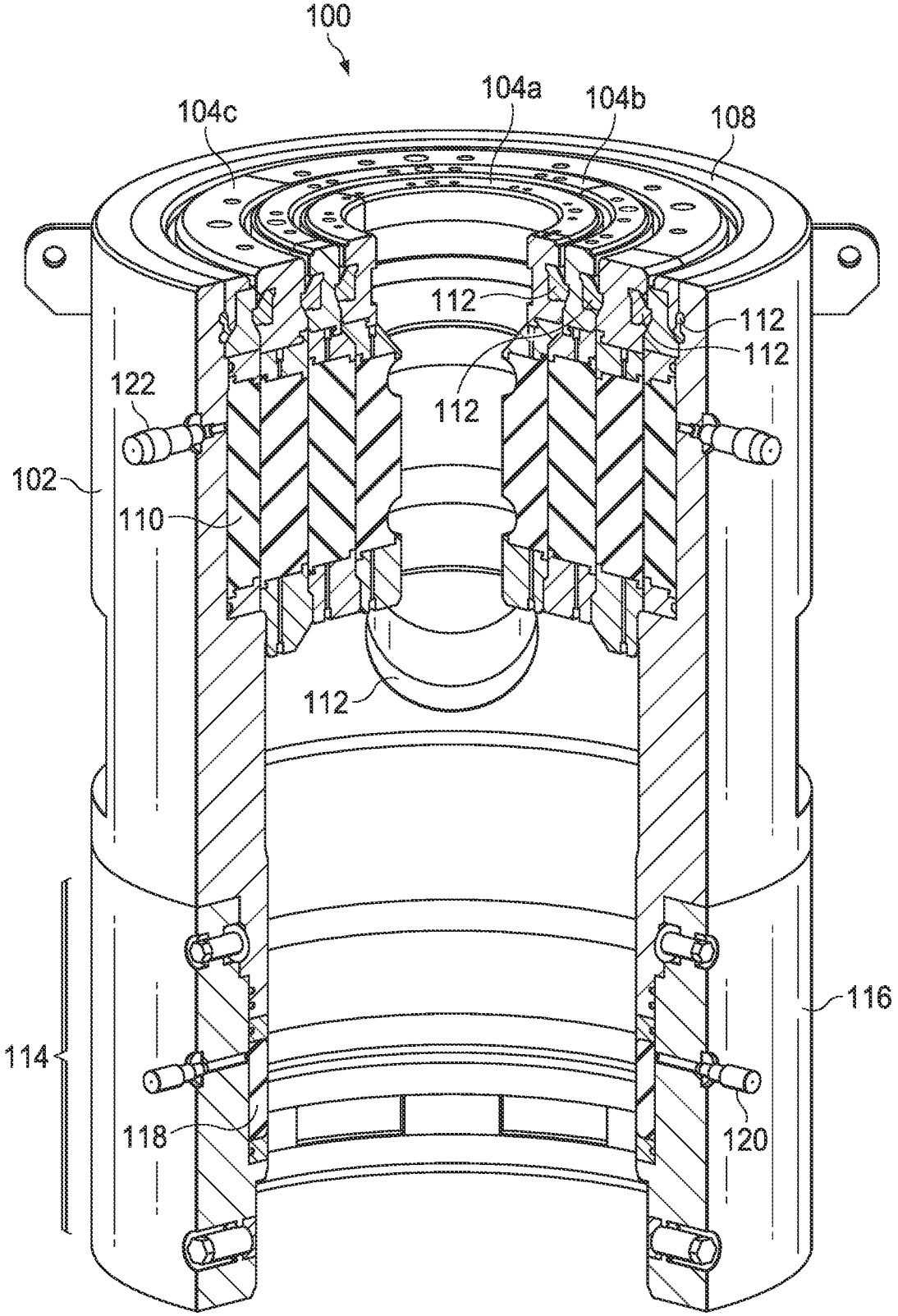
FIG. 1 is a schematic view of a well diverter system.

FIG. 1 is a schematic view of an example well diverter system 100. The diverter 100 is a portable device that is configured for installation on a well conductor. The well conductor includes a pipe configured to remove hydrocarbons from the subsurface. The diverter 100 is configured to form a pressure-tight seal on the conductor to divert gas pockets that are encountered in the subsurface during hydrocarbon exploration and drilling. The diverter 100 includes a housing 102, a plurality of packing elements 104*a-c* (also packing elements 104), and an overshot spool-type connector 106.

The housing 102 includes a rigid body (such as steel). The housing 102 provides a structure for supporting the packing elements 104. The housing 102 is configured to surround a conductor of the well bore. The housing 102 is a rigid frame that supports the packing elements 104 of the diverter system and that is coupled to the casing. The packing elements 104 are inside the housing 102 and form concentric rings around the well bore. A diverter outlet 114 is configured to divert flow of the gases and fluids away from the well bore to prevent to protect the drilling platform from well kicks.

The packing elements 104 in the diverter system 100 seal around the conductor pipe suspended through a drilling rig's rotary table. The diverter system 100 isolates the rig floor (or other drilling platform) from fluids and gases flowing from the well bore. The packing elements 104 are configured to be inserted in the housing 102 in different combinations to accommodate different diameter conductor pipes. For example, a range of split insert packing elements 104*a-c* can each be inserted to protect the well bore during both drilling and casing operations. The packing elements 104 can include a 10-inch split packing element 104*a*, an 18-inch split packing element 104*b*, and a 27.5-inch solid packing element 104*c*, surrounded by a packing retaining ring 108. A main packing element 110 interfaces the packing elements 104 with the housing to couple the packing elements 104 to the housing 102. The packing elements 104 can be run through a 37.5-inch rotary table.

The packing elements 104 can be inserted individually and independent of using hydraulics. For example, the packing elements 104 each include weight-set, locking ring style auto-locking components, such as locking rings 112.

The diverter includes an overshot connector 114 in a lower body 116 of the housing 102. An overshot packer 118 is hydraulically controlled by an actuating port 120. The overshot packer 118 is an adaptor spool configured to stab over and seal a field-cut conductor casing (typically a 36-inch pipe casing). The overshot packer 118 provides an elastomer seal from the pipe to the diverter system 100. The overshot packer 118 is configured to withstand end-load forces and contain gas or fluid when shallow gas encounters occur.

The main packing element 110 is coupled to the housing 102. In an example, the main packing element 110 includes a tubular elastomer seal with metal rings molded on each end. The main packing element 110 can be a single piece that is retained in the housing 110 by a packing element load ring 108. The main packing element 110 is configured to operate the split packing elements 104 when the diverter system 100 is closed. Generally, hydraulic pressure deflects the packing element 110 toward the well bore, which in turn deflects the packing elements 104.

The packing elements 104, including the solid and split insert packing elements 104*a-c*, are configured to close and seal around various pipe sizes, as described in this specification. The packing elements 104 can each include an elastic tubular seal material having metal rings coupled to each end of the tube. The split insert packing elements 104*a-c* are split in half such that each can be installed or retrieved while the pipe of the well bore is suspended through a rotary table of the well bore. The rotary table includes a mechanical device on a drilling rig that provides clockwise (as viewed from above) rotational force to the drill string to facilitate the process of drilling a borehole.

For each of the split packing elements 104*a-c*, a respective spring-loaded lockdown ring (e.g., one of rings 112) is coupled to a top of that packing element 104*a-c* and retains the respective packing element within the diverter system 100. Each packing element 104*a-c* is retained into the larger packing element next to that packing element. For example, packing element 104*a* is retained in packing element 104*b*. Packing element 104*b* is retained by one of rings 112 in packing element 104*c*. Packing element 104*c* is retained by one of rings 112 in the main packing element 110 (e.g., a solid packing element).

In some implementations, the packing elements 104*a-c* can be retrieved or inserted via tapped holes in the top of the respective split packing element halves. Retrieving rods (not shown) interface with the tapped holes and remove or insert the packing elements 104 into the well bore around the pipe.

Packing element 110*a* is a 10-inch packing element configured to be the innermost packing element when used. The packing element 110*a* can be configured to operate hydraulically under 925 PSI to a minimum closing distance of 4.5 inches. Packing element 104*b* is coupled to the packing element 104*c*. The packing element 104*b* can be operated between 18 inches and 9.625 inches under 850 PSI. Packing element 104*c* includes a 27.5-inch split packing element configured to couple to the main packing element 110. Packing element 104*c* operates between 27.5 inches and 26 inches under 750 PSI.

The main packing element 110 can include a 32.5-inch packing element that is solid. The packing element 110 is coupled with the housing 102. The packing element 110 can have a closing diameter between 32.5 inches and 28 inches.

The packing element 104*c* inside diverter body is typically configured to tighten to a diameter of 26 inches. The packing element 104*c* can be operated through port 122 that is in communication with the main packing element 110. A pressure of 750 PSI is generated by energizing the main packing element 110. The packing element 104*c* can close to a diameter of 26 inches in a typical scenario. The packing element 104*c* is modified with increased elasticity to close to a diameter of 24 inches to enable a pipe to be used that has a diameter of 24 inches. The modified packing element 104*c* is increasing the elasticity to be operationally pressured up to 1000 PSI. The packing element 104*c* is described further in relation to FIG. 2.

Figure 2:
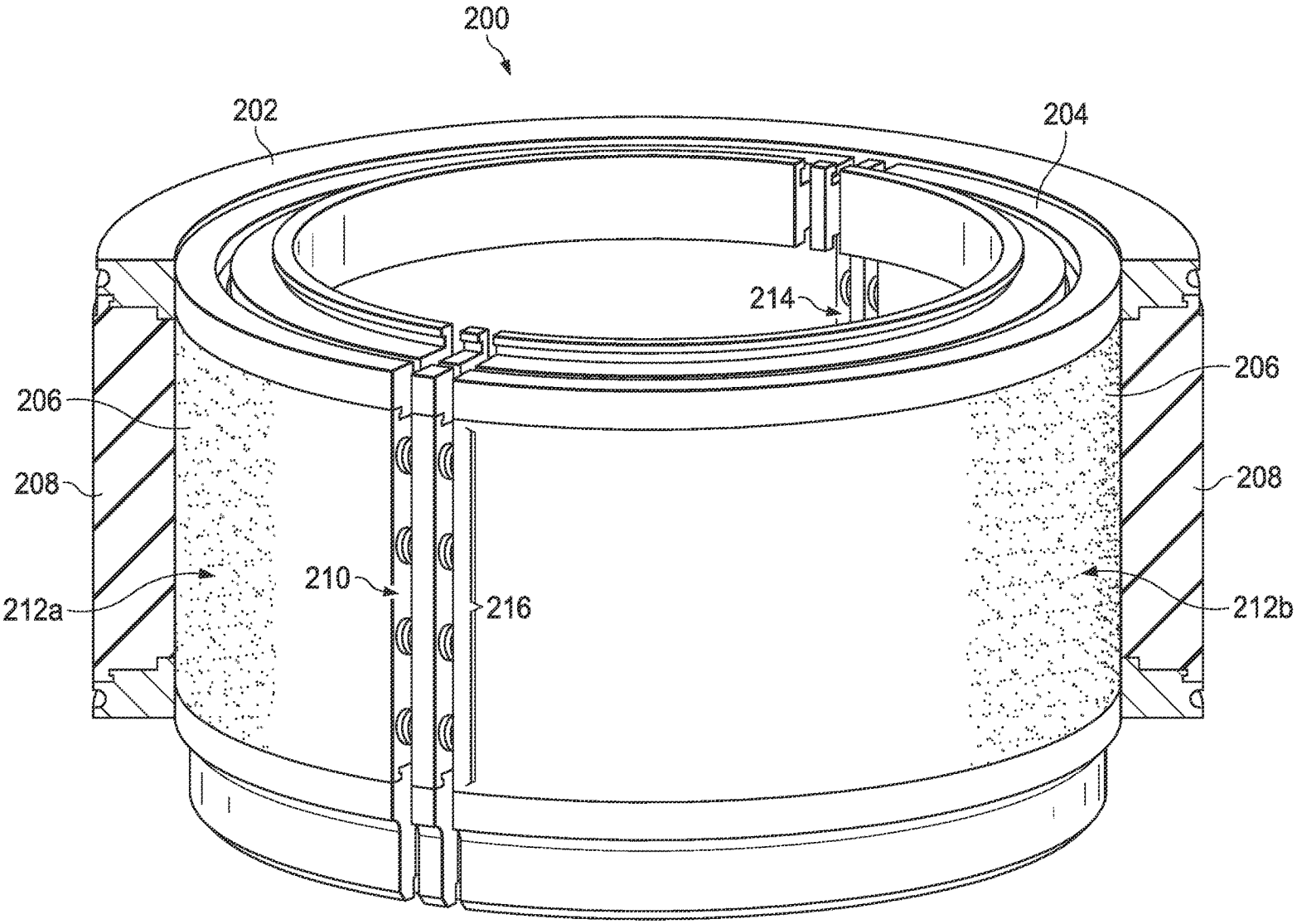
FIG. 2 is a schematic view of a packing element.

FIG. 2 is a schematic view of a packing element system 200. The packing element system 200 includes a solid packing element 202 and a split insert packing element 204. The packing element system 200 is configured for use with the diverter system 100 of FIG. 1. The packing element system 200 enables the diverter system to couple to a pipe having a diameter of 24 inches. The inner packing element 204 is similar to packing element 104*c* of FIG. 1. The outer packing element 202 is similar to packing element 118 of FIG. 1. The packing element 204 includes a 27-inch split packing element configured for placement within the main packing element 202 (e.g., packing element 118 of FIG. 1). For example, the packing element 204 can be placed within a 32-inch solid packing element 202.

The packing element 202 is a solid packing element configured to interface with a housing of the diverter system (e.g., housing 102 of diverter system 100 of FIG. 1). The packing element 202 includes a high performance polymer material forming balloons 208 configured to inflate responsive to air applied through an external port (e.g., port 122 of FIG. 1). The polymer material of balloons 208 can include one or more of the following materials. Examples of possible materials include fluorocarbon (Viton) or fluorocarbon (FKM) compounds, which combine high temperature resistance with relatively high chemical resistance. Generally, the polymer is configured to operate in temperatures between −15° F. to 400° F. and have a hardness of 50-95 durometer shore A. Example pressures are up to 3000 psi.

The polymer material of balloons 208 is configured to withstand 1000-1300 PSI during expansion. The expansion of the polymer balloons 208 pushes on the split packing element 204 to constrict the packing element to a diameter between 27.5 inches and 24 inches. The polymer material of balloons 208 generally has an elasticity of approximately 50%-55% such that there is a tight seal around the 24-inch casing. Generally the material elasticity is capable of resisting deformation under pressures of at least 1000 psi-1500 psi, being rated for pressures of 3000 psi.

The packing element 204 includes a 27-inch split packing element configured to constrict to 24 inches for sealing a 24-inch casing during drilling operations. The packing element 204 is placed within the packing element 202. A diameter of the packing element 204 can be controlled by inflating the polymer balloons 208, which forms balloons around the packing element 204. When the balloons of the polymer material of balloons 208 are inflated, the packing element 204 is constricted around the casing that is present in the diverter system. The balloons can expand to compress the packing element 204 which can vary up to 10 inches in diameter.

The split packing element 204 can include sections 212*a* and 212*b*. Sections 212*a* and 212*b* can each form half of the split packing element 204. The halves 212*a-b* of the split packing element 204 can be coupled together by one or more elastic elements 216 that are positioned within splits 210, splits 214, or both splits 210 and splits 214 between the packing element halves 212*a-b*. The elastic elements can include springs, such as helical springs. For example, the helical springs can be metallic, such as steel. In some implementations, another elastic element can be used, such as a compressive or elastic material coupling the frame halves. For example, a stretchable material such as another polymer can be used for the elements 216. The number of elements 216 can vary depending on the size of the packing elements 202, 204. For example, the elements 216 can include a single spring, a dozen springs, or several dozen springs, depending on the elasticity and strength of the individual elements. The springs can be evenly spaced between the two halves 212*a-b* of the packing element 200. In some implementations, additional splits and spring elements are added to create additional sections of the packing element 200 that are coupled by springs or elastic elements 210. Generally, one or more of these sections are configured to be actuated as described for sections 212*a*-212*b*, using additional polymer balloons. The elastic members can be coupled to the packing element using any coupling techniques available, such as bolts, pins, welds, and so forth. In some implementations, the elements 210 are placed as spaced pairs, as shown in FIG. 2. In some implementations, the elements are evenly spaced 210. The spacing is configured to provide an approximately even force distribution between the split packer sections 212*a*-212*b*. In some implementations, the elements can expand up to 6-10 inches.

The packing element 202 includes polymer balloons 206 that are similar to polymer balloons 208 of the polymer material. The polymer material for balloons 206 can be the same material used for balloons 208, but need not necessarily be the same material. The balloons 206 are configured to inflate up to XX inches. Polymer geometry is based on operation, generally within 40 centimeters (cm) to 50 cm in length and 20 cm to 30 cm in thickness The balloons 206 can be inflated using an external port (not shown) accessible outside a housing of the diverter.

The packing element system 200 is configured to enable a pipe diameter of 24 inches within the diverter system 100 based on the interaction between the packing element 202 and the packing element 204. The packing element 204 has increased flexibility and elasticity compared with conventional split packing elements. The increased range of the packing element 204 that enables constriction to 24 inches enables a reduced number of steps for installing the diverter element 100 on a casing, relative to a number of steps generally performed for adding additional packing elements to the diverter system as previously described.

Figure 3:
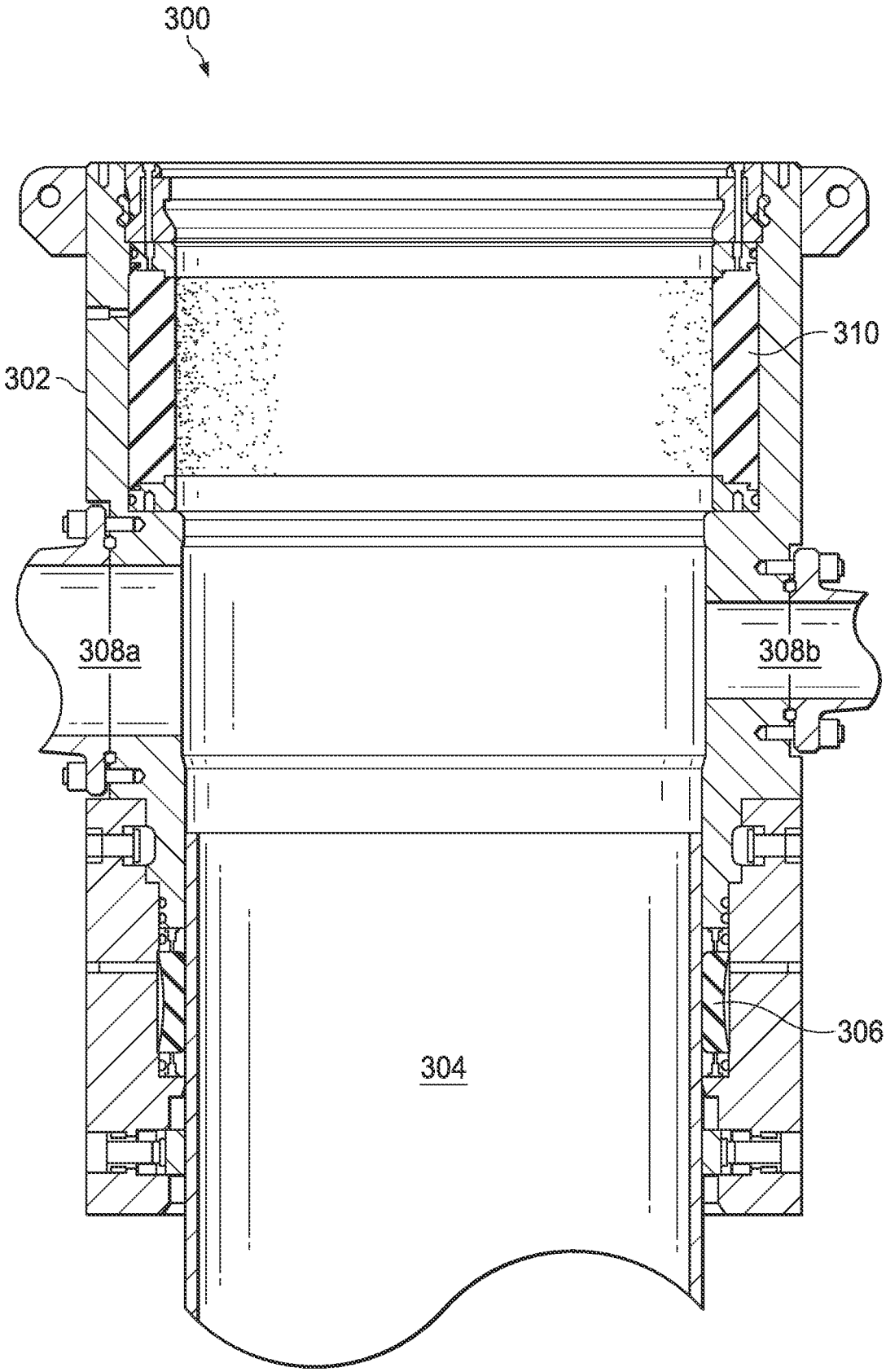
FIG. 3 is a schematic view of a well diverter system at a first step of installing packing elements.

FIG. 3 is a schematic view of a well diverter system 300 at a first step of installing packing elements. The well diverter system 300 includes the diverter system 100 described in relation to FIG. 1. To install the well diverter system 300, a ring is welded on an upper section of a conductor 304. A main body 302 of the diverter system is installed on the conductor 304. The conductor is generally 36 inches. The integral overshot packer 306 includes an adapter spool that stubs over the conductor 304. The overshot packer 306 provides a molded elastomer seal around the field-cut conductor 304. The overshot packer 306 provides a shoulder for the overshot. Outlets 308*a-b* are positioned above the end of the conductor 304. Solid packing element 310 is not yet energized (actuated). The overshot packer 306 is energized to provide a seal to the conductor 304.

Figure 4:
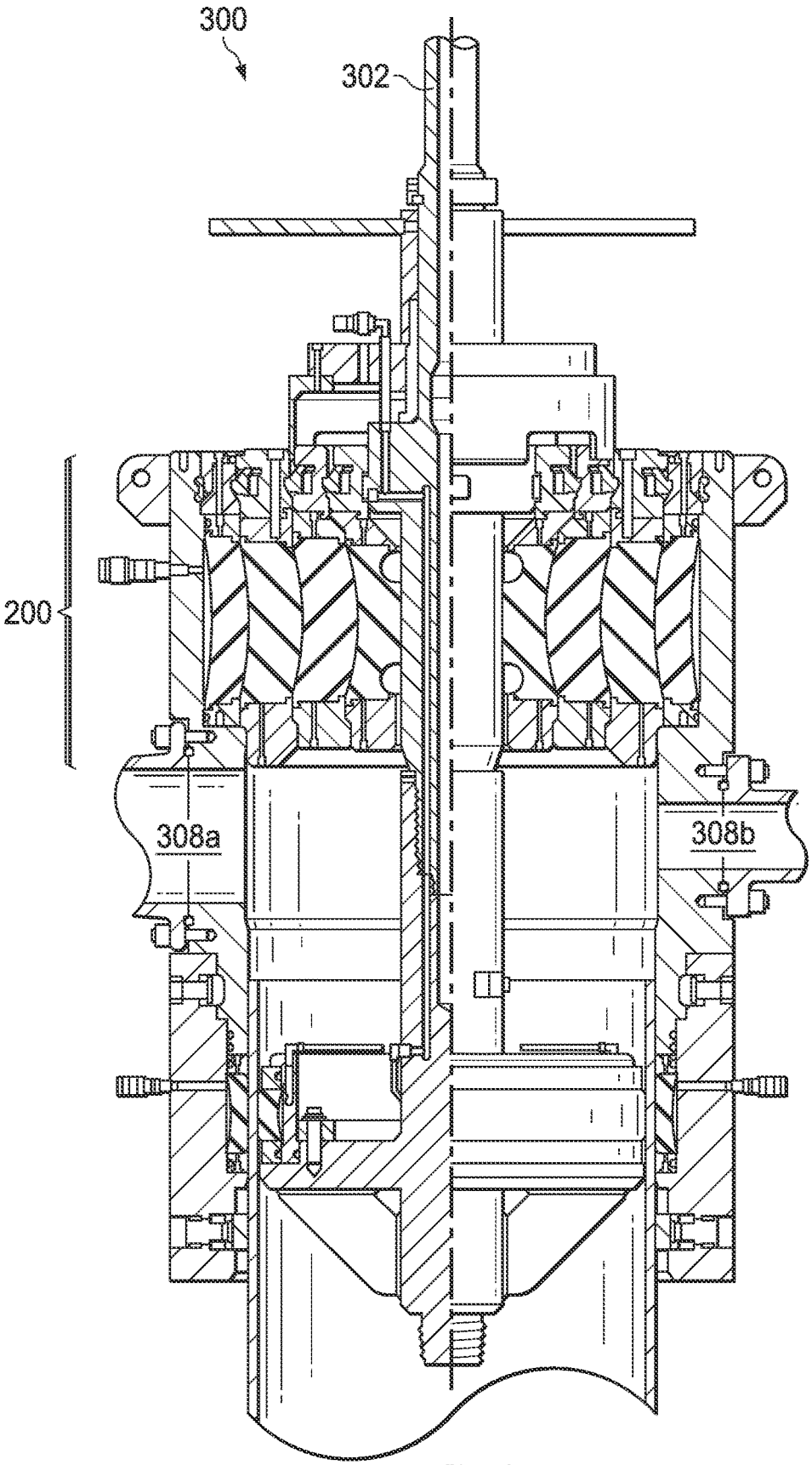
FIG. 4 is a schematic view of the well diverter system of FIG. 3 at a second step of installing packing elements.

FIG. 4 is a schematic view of the well diverter system 300 of FIG. 3 at a second step of installing packing elements including packing element 200. Packing elements 200 are added to the diverter system as previously described. The packing elements 200 include packing element 200. A testing tool 302 is configured to test the actuation of the packing elements 200, including packing element 200. The modified packing element 200 is tested using two tests. First, a function test is performed prior to placement at a rig location. The function test includes squeezing all packers from 30 inches, 28 inches, 18 inches, and 10 inches by pressuring the diverter through the chamber to 500 psi, 1000 psi and 1500 psi, respectively. A second test includes a hydro-test. The hydro-test includes pressurizing the diverter and holding the pressure for a 30 minute test by closing one or more of the diverter valves. The valves that are toggled include a 12-inch ball valve, a 7 1/16-inch diverter valve, and a 2 1/16-inch kill line valve.

Figure 5:
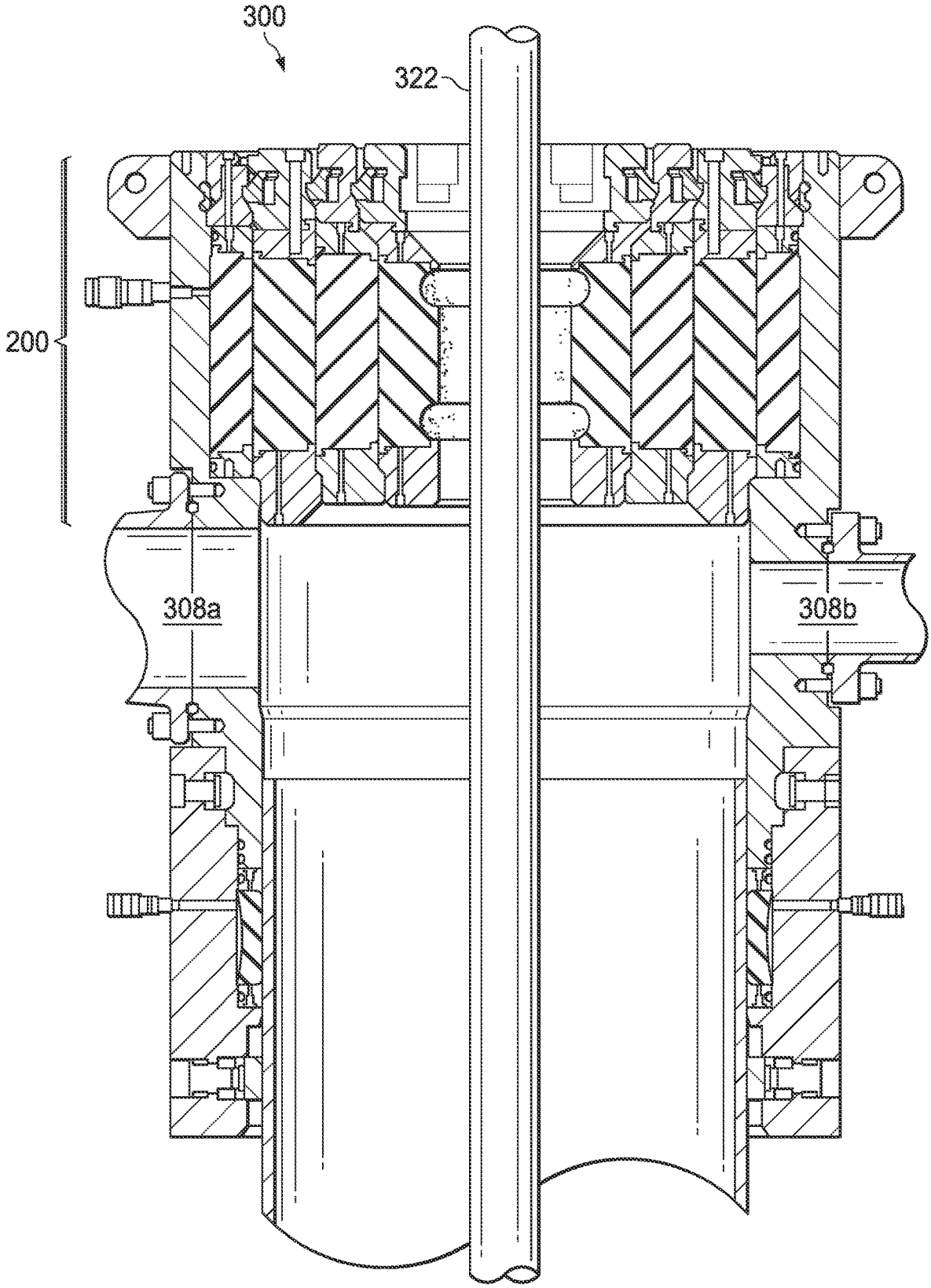
FIG. 5 is a schematic view of the well diverter system of FIGS. 3-4 at a third step of installing packing elements.

FIG. 5 is a schematic view of the well diverter system 300 of FIGS. 3-4 at a third step of installing packing elements. In FIG. 5, the testing tool 302 of FIG. 4 is removed. The split packing assembly 200 is reinstalled in the diverter system 300. A drilling bit pipe 322 that supports the drilling bit is run through the diverter system 300. The packing elements of the assembly 200 generally include packing elements 202 and 204 when the pipe 322 of the drilling bit is 24 inches. The packing elements 202, 204 enable the diverter system 300 to compress and seal the 24-inch diameter of the pipe 322.

The 36-inch diverter is tested before operation at a well site. The packing elements 104 included integral overshot packer handling tool and diverter test tool are tested. The casing spilt insert packers (such as puckering elements 104*a-b*) are installed. A main integral 36-inch packing element 110, which is a fail-safe for 100% sealing, is tested. The 32" solid insert packer 104*c*, the 27-inch spilt insert packer, the 18" spilt insert packing element, and the 10" spilt insert packing element are assembled together while the packing element testing tool is connected and penetrated inside the diverter for further testing.

Once testing is completed, a drill bit pipe is run for drilling the 30-inch surface casing. In this operation, the packing elements seal around the bit pipe, which has diameter that is less the 10-inch packing element. Drilling is performed for the 30-inch surface casing, and the packing elements are disassembled except the 32-inch packing element. The bit pipe is pulled out of the well. A 30-inch casing is run through the diverter with a 32-inch packing element inside the 36-inch diverter body. The packing element is configured to squeeze around the 30-inch casing and hold it. Additional drilling and running of additional casings is performed in a similar process.

After running and cementing the 30-inch surface casing, a second casing stage including a 26-inch casing is run through the well. The 26-inch casing is run and sealed with the 27.5-inch spilt insert packing element. Additionally, the 27.5-inch packing element is used in operation with 24-inch casing used after the 30-inch casing. As previously stated, the diverter system 100 described herein enables avoidance of a nipple down of the 36-inch diverter and a nipple up to the 30-inch annular, which would use different equipment to enable a seal around the 24-inch casing and a long lead time of 2-3 days. The diverter system 100 is configured to seal around all casings, even those less than 24-inches. The diverter system 100 including the previously described polymers with high elasticity and including the springs integrated in the 27.5-inch spilt insert enables the packing element to seal from 30-inches to less than 24-inches for the diameter casing.

Generally, the drill bit is configured to drill out the near surface for the surface casing. The packing elements 202, 204 of the packing element assembly 200 are closed during operations to divert any fluids or gases out of outlets 308*a-b* of the diverter system 300.

Figure 6:
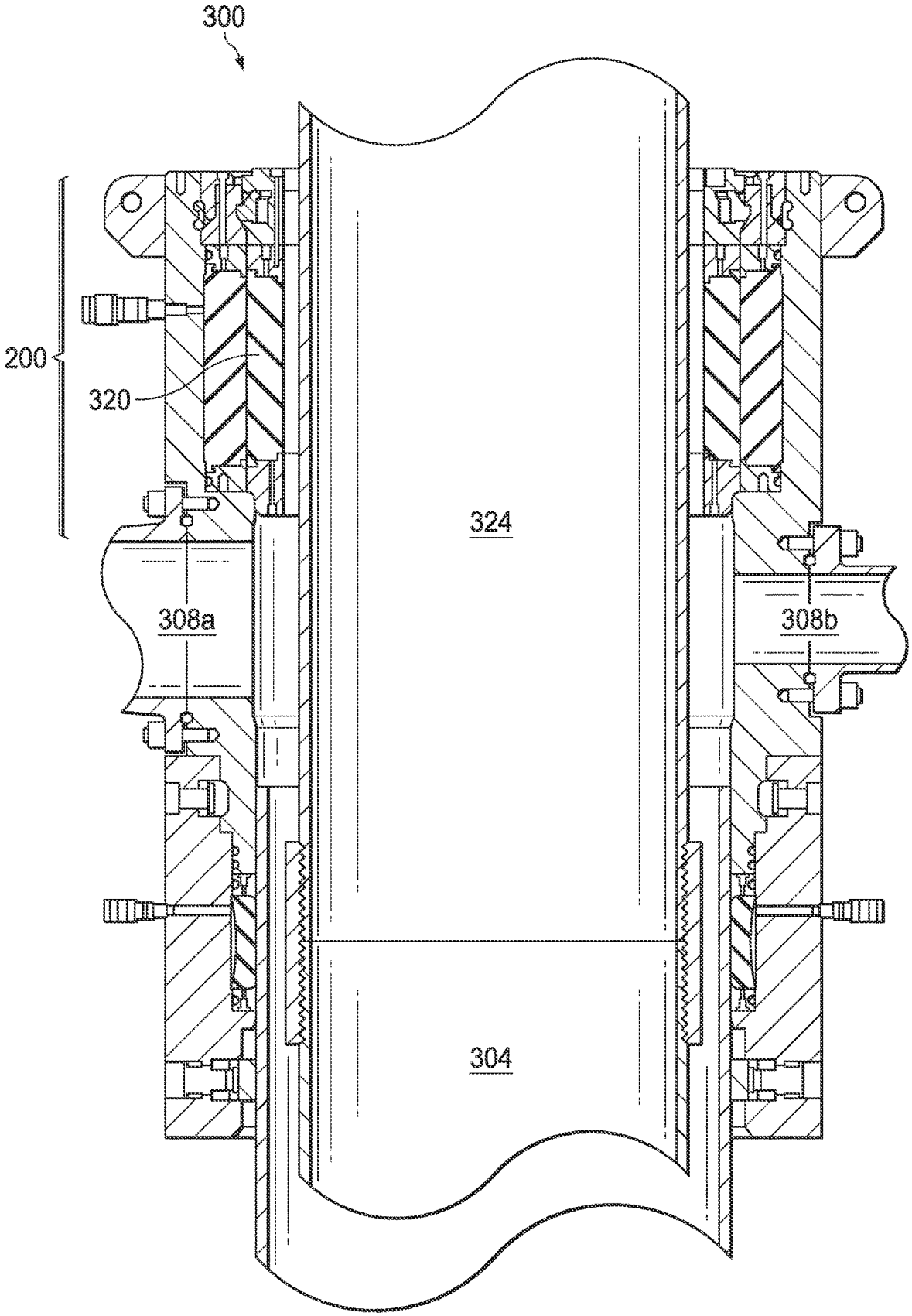
FIG. 6 is a schematic view of the well diverter system of FIGS. 3-5 at a fourth step of installing packing elements.

FIG. 6 is a schematic view of the well diverter system 300 of FIGS. 3-5 at a fourth step of installing packing elements. Packing elements 200 of the diverter system 300 are relaxed as balloons 206, 208 are deflated. A surface casing 324 is run to casing 304 in diverter system 300. In some implementations, the packing elements 200 are replaced with a solid insert packer 320 configured to seal around the casing 324 during installation of the surface casing. The surface casing can generally be 30 inches.

The packing element described herein enables one or more following changes to the workflow of casing installation. In a typical process, the 30-inch surface casing is run and is cemented. The second casing stage at 26-inches is run and sealed using the 27.5-inch spilt insert packing element. For subsequent operation of the 24-inch casing after the 30-inch casing, a nipple down of the 36-inch diverter is performed and a nipple up of the 30-inch annular is performed, as a different device is used to enable the operator to seal around the 24-inch casing. The diverter system 100 with the packing element 200 is configured to seal around all casings, including those less than 24-inches, with a 36-inch diverter. This eliminates the requirement of a nipple down of the 36-inch diverter and nipple up of the 30-inch annular, in addition to another nipple down and nipple up of the blow out preventer (BOP).

Figure 7:
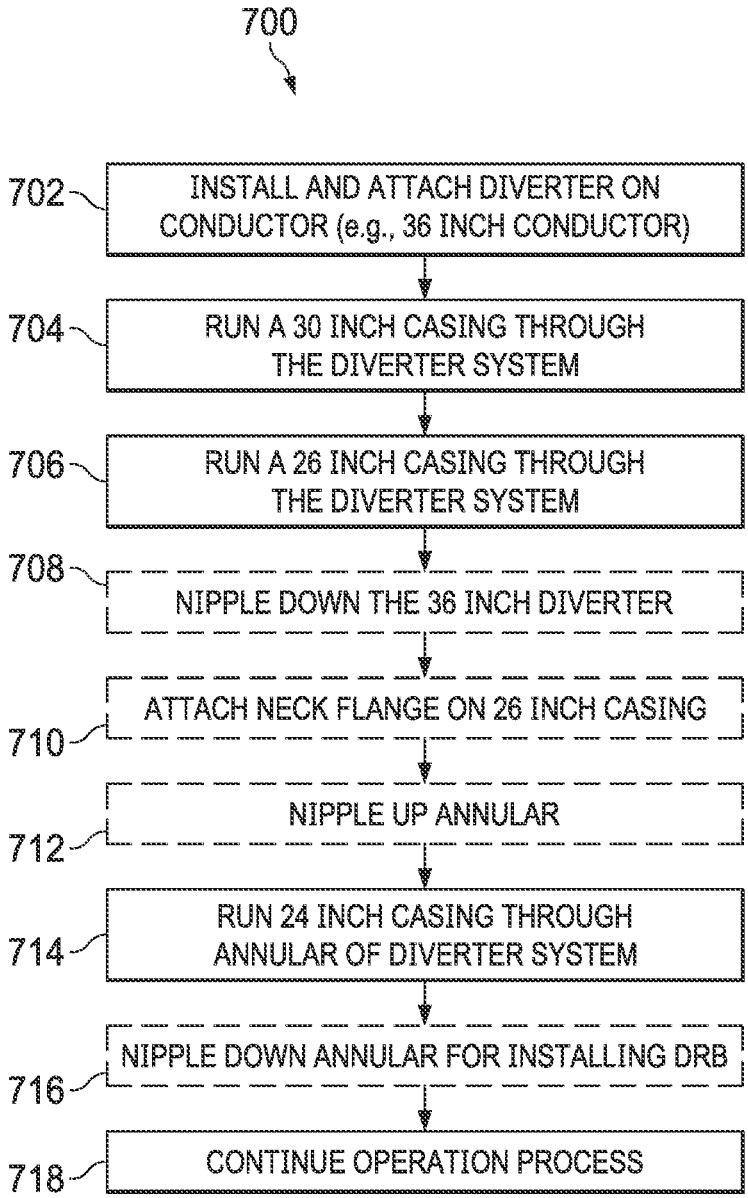
FIG. 7 is a flow diagram showing an example process for operation of a well diverter system.

FIG. 7 is a flowchart of an example of a process 700 for operation of a well diverter system, according to some implementations of the present specification, such as the diverter systems 100, 300 described previously in relation to FIGS. 1-6. For clarity of presentation, the description that follows generally describes process 700 in the context of the other figures in this description. However, it will be understood that process 700 can be performed, for example, by any suitable system, environment, and hardware, or a combination of systems, environments, and hardware, as appropriate.

Generally, several steps can be eliminated from a typical process of installation of the diverter system that are performed when the packing elements 200 are not available. The steps that are not necessary to perform are shown as dashed boxes in the flow diagram of FIG. 7. These steps generally relate to adjusting the diverter system by nipple up and nipple down operations that increase the range of the diverter system to accommodate 24-inch casing.

The process 700 includes installing (702) the diverter system on the conductor. In some implementations, the conductor includes a 36-inch conductor. A 30-inch casing is run through (704) the diverter system. A 26-inch casing is run through (706) the diverter system.

The process 700 includes running (714) a 24-inch casing through the diverter system. The diverter system is ready for the 24-inch casing immediately after the 26-inch casing is run through the diverter system because of the increased flexibility of the packing elements assembly 200. The process 700 can skip the step of a nipple down (708) of the 36-inch diverter. The process 700 can skip the step of attaching (710) a neck flange on the 26-inch casing. The process 700 can skip the step of a nipple up (712) of the annular of the diverter system. Steps 708, 710, and 712 are performed to enable a diverter system without the packing element assembly 200 previously described to enable that system to seal a 24-inch casing. Each of steps 708, 710, and 712 cause delays and potentially introduce leaks in the diverter system.

As a result, the diverter system can directly seal the 24-inch casing without nipple down of the diverter or nipple up of the annular. This simplifies installation of the diverter system and reduces a time required for installing the diverter system. Without the annular, there is no need to nipple down (716) the annular for installing the blow out preventer (BOP). The diverter can seal the 24-inch casing for performing surface casing installation.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

A number of embodiments have been described. Nevertheless, it will be understood that various modifications may be made without departing from the scope of this specification. Accordingly, other embodiments are within the scope of the following claims.

What is claimed is:

1. A diverter system configured to control a direction of drilling fluid or gas from a well bore to a surface platform, the diverter system comprising:

a housing configured to receive a casing from a well bore;

at least one outlet configured to direct flow of a drilling fluid or gas out of the housing; and a packing element assembly within the housing and coupled to the housing, the packing element assembly comprising:

a first packing element affixed to the housing, the first packing element comprising at least one balloon configured to expand in response to an actuation input; and a second packing element concentrically within the first packing element, the second packing element comprising a first half and a second half, the first half coupled to the second half by a plurality of elastic elements;

wherein the second packing element is configured to receive the casing from the well bore; and wherein the at least one balloon of the first packing element is configured to compress the second packing element around the casing to seal the second packing element against the casing, preventing flow of the drilling fluid or gas past the packing element assembly and directing the flow of the drilling fluid or gas to the at least one outlet.

2. The diverter system of claim 1, wherein at least one of the plurality of elastic elements comprises a helical spring.

3. The diverter system of claim 1, wherein the at least one of the plurality of elastic elements comprises a stretchable material.

4. The diverter system of claim 1, wherein the at least one of the plurality of elastic elements is configured for over 50% elasticity.

5. The diverter system of claim 1, wherein the second packing element comprises a least one secondary balloon configured to inflate in response to actuation from an external port, wherein actuation of the secondary balloon seals the second packing element to the casing.

6. The diverter system of claim 1, wherein the casing is approximately 24 inches, and wherein the second packing element is configured to contract from about 27.5 inches to 24 inches.

7. The diverter system of claim 1, wherein the at least one balloon comprises a polymer material that comprises fluorocarbon.

8. The diverter system of claim 1, wherein the first packing element is a solid packing element, and wherein the second packing element is a split packing element.

9. The diverter system of claim 1, wherein the at least one balloon is actuated by an actuation signal of 1000 to 1300 pounds per square inch (PSI).

10. A packing element assembly for a diverter system that is configured to control a direction of drilling fluid or gas from a well bore to a surface platform, the packing element assembly comprising:

a first packing element comprising at least one balloon configured to expand in response to an actuation input; and a second packing element concentrically within the first packing element, the second packing element comprising a first half and a second half, the first half coupled to the second half by a plurality of elastic elements;

wherein the second packing element is configured to receive a casing from the well bore; and wherein the at least one balloon of the first packing element is configured to compress the second packing element around the casing to seal the second packing element against the casing, preventing flow of the drilling fluid or gas past the packing element assembly and directing the flow of the drilling fluid or gas to at least one outlet.

11. The packing element assembly of claim 10, wherein at least one of the plurality of elastic elements comprises a helical spring.

12. The packing element assembly of claim 10, wherein the at least one of the plurality of elastic elements comprises a stretchable material.

13. The packing element assembly of claim 10, wherein the at least one of the plurality of elastic elements is configured for over 50% elasticity.

14. The packing element assembly of claim 10, wherein the second packing element comprises a least one secondary balloon configured to inflate in response to actuation from an external port, wherein actuation of the secondary balloon seals the second packing element to the casing.

15. The packing element assembly of claim 10, wherein the casing is approximately 24 inches, and wherein the second packing element is configured to contract from about 27.5 inches to 24 inches.

16. The packing element assembly of claim 10, wherein the at least one balloon comprises a polymer material that comprises fluorocarbon.

17. The packing element assembly of claim 10, wherein the first packing element is a solid packing element, and wherein the second packing element is a split packing element.

18. The packing element assembly of claim 10, wherein the at least one balloon is actuated by an actuation signal of 1000 to 1300 pounds per square inch (PSI).

* * * * *